US005387962A

United States Patent [19]

Castelli et al.

[11] Patent Number: 5,387,962

[45] Date of Patent: Feb. 7, 1995

[54] SELF-ALIGNING ROLL FOR BELT LOOP MODULES

[75] Inventors: Vittorio Castelli, Yorktown Heights; Harold Brown, New City, both of N.Y.; Stephen T. Chai, Rancho Palos Verde, Calif.

[73] Assignee: Xerox Corporation, Stamford, Conn.

[21] Appl. No.: 165,622

[22] Filed: Dec. 13, 1993

[51] Int. Cl.[6] ..... G03G 5/00

[52] U.S. Cl. ..... 355/212; 355/213; 198/806

[58] Field of Search ..... 355/212, 213, 211; 198/806, 807, 808, 840, 843; 226/21, 19, 18, 15

[56] References Cited

U.S. PATENT DOCUMENTS

| | | | |
|---|---|---|---|
| 2,593,157 | 4/1952 | Lorig | 198/840 X |
| 3,107,036 | 10/1963 | Richards et al. | 226/19 X |
| 3,540,571 | 11/1970 | Morse | 226/21 X |
| 3,973,446 | 8/1976 | Vasilantone | 226/21 X |
| 4,061,222 | 12/1977 | Rushing | 198/807 |
| 4,170,175 | 10/1979 | Conlon, Jr. | 101/1 |
| 4,174,171 | 11/1979 | Hamaker et al. | 355/212 |
| 4,344,693 | 8/1982 | Hamaker | 355/212 |
| 4,397,538 | 8/1983 | Castelli et al. | 198/806 X |
| 4,483,607 | 11/1984 | Nagayama | 355/212 |
| 4,547,059 | 10/1985 | Nagayama et al. | 198/806 X |
| 4,552,295 | 11/1985 | Smith et al. | 198/807 X |
| 4,572,417 | 2/1986 | Joseph et al. | 226/20 |
| 4,961,089 | 10/1990 | Jamzadeh | 355/207 |
| 4,996,563 | 2/1991 | Blanding | 355/212 |
| 5,019,864 | 5/1991 | Blanding | 355/212 |
| 5,078,263 | 1/1992 | Thompson et al. | 198/807 |
| 5,246,099 | 9/1993 | Genovese | 198/807 |
| 5,248,029 | 9/1993 | Valcalda | 198/808 |

FOREIGN PATENT DOCUMENTS

| | | | |
|---|---|---|---|
| 0188314 | 8/1986 | Japan | 198/843 |
| 0112311 | 5/1988 | Japan | 198/806 |
| 0803974 | 11/1958 | United Kingdom | 226/15 |

*Primary Examiner*—Matthew S. Smith
*Attorney, Agent, or Firm*—Kevin R. Kepner

[57] ABSTRACT

An apparatus for guiding a moving web, particularly in an electrophotographic printing machine of the type having an endless photoreceptor belt supported by a plurality of rolls and arranged to move in a predetermined path through a plurality of processing stations disposed therealong the web being of the type which is supported by a plurality of rolls. A roll for supporting the web and in frictional contact therewith is adapted for rotational movement about a first axis. A roll support in the form of a dead shaft allows the roll laterally move to pivot about a second axis in a direction substantially normal to the predetermined path direction. This is accomplished by supporting the dead shaft on a V-groove roller which rides in a track substantially along the arc of rotation normal to the predetermined path direction. Any web tracking normal to the predetermined direction exerts a friction force on the roll causing the roll to pivot about the second axis as a result of the v-groove rollers moving along the tracks in a direction substantially normal to the predetermined direction such that the roll aligns itself so that its axis of rotation is substantially perpendicular to the direction of travel of the belt.

18 Claims, 6 Drawing Sheets

UI
CONTROLLER
ESS

SELF-ALIGNING ROLL FOR BELT LOOP MODULES

This invention relates generally to a system belt guiding, and more particularly concerns a compact self-aligning roller to maintain proper belt tracking characteristics.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

Many commercial applications of the above process employ a photoconductive member in the form of a belt which is supported about a predetermined path past a plurality of processing stations to ultimately form a reproduced image on copy paper. The location of the latent image recorded on the photoconductive belt must be precisely defined in order to have the various processing stations acting thereon optimize copy quality. To this end, it is critical that the lateral alignment of the photoconductive belt be controlled within prescribed tolerances. Only in this manner will a photoconductive belt move through a predetermined path so that the processing stations disposed thereabout will be located precisely relative to the latent image recorded thereon. Lateral movement of the photoconductive belt is particularly a problem in connection with color copiers where the precise tracking of the belt is mandatory for acceptable copy quality.

When considering control of the lateral movement of the belt, it is well known that if the belt were perfectly constructed and entrained about perfectly cylindrical rollers mounted and secured in an exactly parallel relationship with one another, there would be no lateral movement of the belt. In actual practice, however, this is not feasible. Due to the imperfections in the system's geometry, the belt velocity vector is not normal to the roller axis of the rotation, and the belt will move laterally relative to a roller until reaching a kinematically stable position.

Existing methods of controlling the lateral movement of a belt comprise servo systems, crowned rollers and flanged rollers. Servo systems use steering rollers to maintain lateral control of the belt. While they generally apply less stress to the sides of the belt than do crowned rollers and flanged rollers, servo systems are frequently rather complex, costly and require a large space within the machine. Crowned and flanged rollers while being inexpensive, frequently produce high local stresses resulting in damage to the edges of the belt. Furthermore, the functioning of crowned rollers relies on their maintaining intimate contact with the belt over their entire axial extent, which fact requires great accuracy in manufacturing when used with substantially inextensible belt such as those employed as photoreceptors and intermediates.

Accordingly, it is desirable to develop a belt steering system that is relatively simple and compact yet avoids the high localized stresses of crowned and flanged rollers.

The following disclosures may be relevant to various aspects of the present invention:

U.S. Pat. No. 4,061,222
Inventor: Rushing
Issue Date: Dec. 6, 1977

U.S. Pat. No. 4,572,417
Inventor: Rushing
Issue Date: Dec. 6, 1977

U.S. Pat. No. 4,572,417
Inventor: Joseph et al.
Issue Date: Feb. 25, 1986

U.S. Pat. No. 4,170,175
Inventor: ConIon, Jr.
Issue Date: Oct. 9, 1979

U.S. Pat. No. 4,174,171
Inventor: Hamaker et ano.
Issue Date: Nov. 13, 1979

U.S. Pat. No. 4,344,693
Inventor: Hamaker
Issue Date: Aug. 17, 1982

U.S. Pat. No. 4,961,089
Inventor: Jamzadeh
Issue Date: Oct. 2, 1990

U.S. Pat. No. 5,078,263
Inventor: Thompson et al.
Issue Date: Jan. 7, 1992

The relevant portions of the foregoing disclosures may be briefly summarized as follows:

U.S. Pat. No. 4,061,222 to Rushing discloses an apparatus for tracking an endless belt along an endless path by a tiltable belt steering roller whose position is continually adjusted so that the belt is maintained at a stable equilibrium position despite changes in the belt shape. The adjustment is determined by control circuitry which produces signals representative of lateral belt edge position, a desired belt edge position, and either a steering roller position or an instantaneous lateral belt deviation rate to produce a control signal which is applied to a gear motor to control the tilt angle of the steering belt roller. This apparatus utilizes the absolute control method.

U.S. Pat. No. 4,572,417 to Joseph et al. discloses an apparatus for controlling lateral, cross track alignment of a web moving along a path to minimize lateral deviation between successive discrete areas of the web. A steering roller supports the web for movement along the path and is rotatable about an axis perpendicular to a plane of the span of the web approaching the steering roller.

U.S. Pat. No. 4,170,175 to ConIon, Jr. discloses a system for tracking an endless belt which automatically compensates for creep of the belt. The belt is supported by four rollers. A first is a drive roller, a second and third are idler rollers, and a fourth roller is an idler roller with flared ends. The flared roller provides passive tracking without electronic or active feedback. One of the idler rollers is spring loaded such that when an edge of the belt creeps up on one of the flared ends of the fourth roller, that side of the spring loaded roller is caused to tilt due to increased belt stiffness on that side. This positions the belt laterally toward a central position.

U.S. Pat. No. 4,174,171 to Hamaker et ano. discloses an apparatus for controlling the lateral alignment of a moving photoconductive belt. A resilient support constrains lateral movement of the belt causing a moment to be applied to a pivotably mounted steering post. As a result, the steering post pivots in a direction to restore the belt along a predetermined path. This apparatus is passive and provides no active electronic feedback.

U.S. Pat. No. 4,344,693 to Hamaker discloses an apparatus for controlling the lateral alignment of a moving photoconductive belt. Lateral movement of the belt causes a frictional force to be applied to the belt support. The frictional force tilts the belt support to restore the belt to the predetermined path of movement. This apparatus is passive and provides no active electronic feedback.

U.S. Pat. No. 4,961,089 to Jamzadeh discloses a method and apparatus for controlling lateral movement of a web along an endless path. The lateral position of the web is monitored and a determination is made by a control unit if the web is within predetermined limits such that a copying operation can be completed while the web is still properly tracking. If the web is not tracking properly, or if it is predicted that the web will track beyond its predetermined lateral limits within a copying operation, a correcting step is taken prior to the copying operation. The correcting step determines a tilt angle for a steering roller. Upon completion of the correcting step, the apparatus returns to a monitoring capacity and does not provide corrective measures until the web is beyond or is predicted to go beyond the predetermined limits during a subsequent copying operation. This insures that copying operations have proper registration and do not include corrective steps during the copying operation which might interfere with the registration. This apparatus uses an absolute scheme to determine corrective action.

U.S. Pat. No. 5,078,263 to Thompson et al. discloses an active steering method that introduces corrective skew through a small rotation about the "soft-axis" of one or more idler rolls. The skew is introduced by an external connection to a servo-motor to alter the angle at which the web enters or leaves the roll to cause the web to walk along the roll.

In accordance with one aspect of the present invention, there is provided an apparatus for supporting a web moving along a predetermined path. The apparatus includes a frame and a member mounted movably in said frame in frictional contact with the web to provide support therefor, said member having an axis substantially normal to the predetermined path, said member being frictionally moved by the web, in response to the web having a direction of travel deviating from the predetermined path, in a direction substantially perpendicular and parallel to the path to substantially align the axis with the direction of travel of the web so as to minimize lateral stress on the web.

Pursuant to another aspect of the present invention, there is provided an electrophotographic printing machine of the type having an endless photoreceptor belt supported by a plurality of rolls and arranged to move in a predetermined path through a plurality of processing stations disposed therealong. The improvement includes a frame and a member mounted movably in said frame in frictional contact with the belt to provide support therefor, said member having an axis substantially normal to the predetermined path, said member being frictionally moved by the belt, in response to the belt having a direction of travel deviating from the predetermined path, in a direction substantially perpendicular and parallel to the path to substantially align the axis with the direction of travel of the belt so as to minimize lateral stress on the belt.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 8:
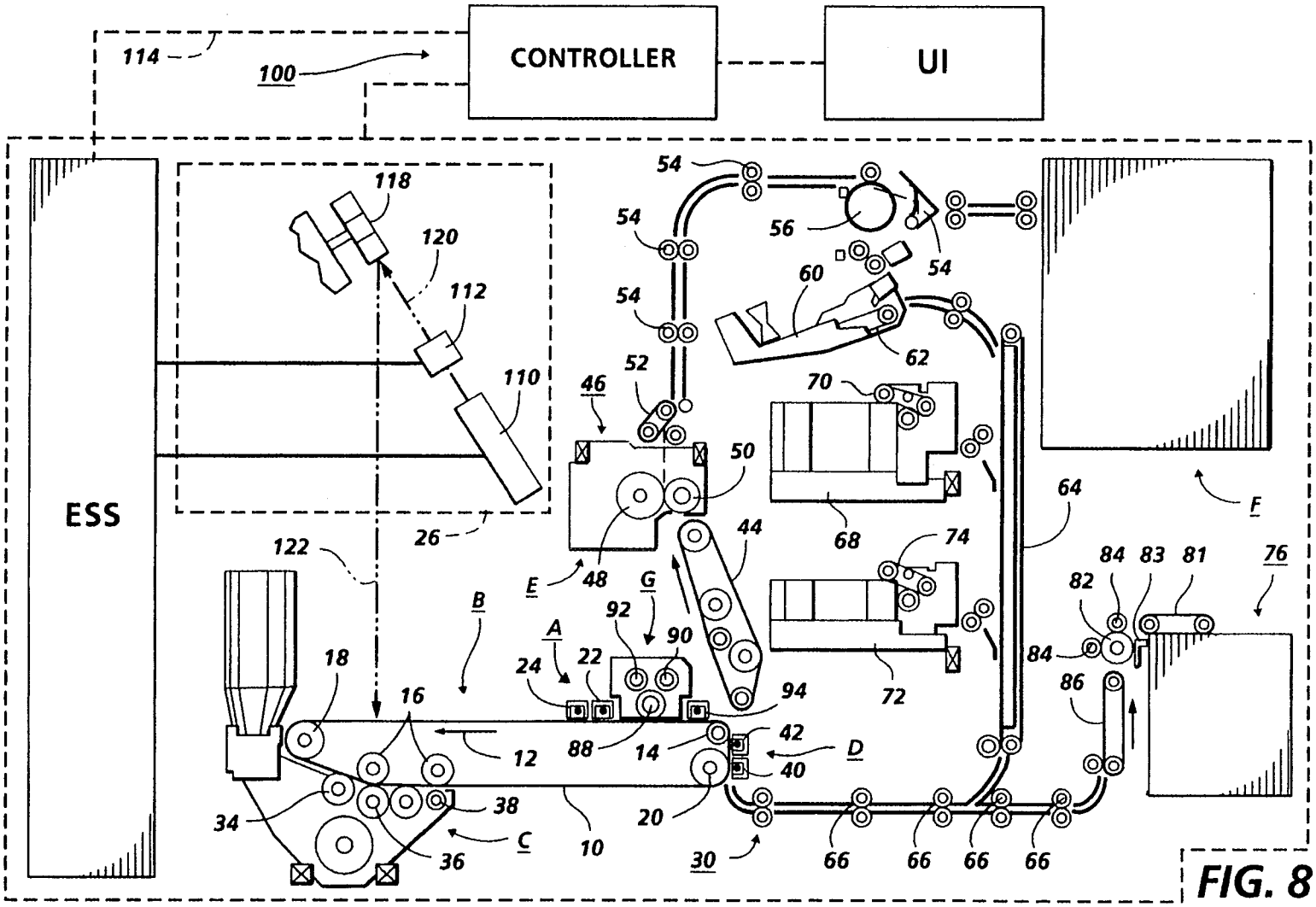
FIG. 8 is a schematic elevational view of an electrophotographic printing machine incorporating the FIG. 2 system therein.

For a general understanding of the features of the present invention, reference is made to the drawings. In the drawings, like reference numerals have been used throughout to identify identical elements. FIG. 8 schematically depicts a monochromatic electrophotographic printing machine incorporating the features of the present invention therein. It will become evident from the following discussion that the system to extend fuser roll life of the present invention may be employed in a wide variety of devices including full process color and highlight color printing machines and is not specifically limited in its application to the particular embodiment depicted herein.

Referring to FIG. 8 of the drawings, the electrophotographic printing machine employs a photoconductive or an electro-receptive belt 10. The preferred photoconductive belt will be described. The photoconductive belt 10 is made from a photoconductive material coated on a ground layer, which, in turn, is coated on an anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar TM. The interface layer aids in the transfer of electrons to the ground layer. The ground layer is very thin and allows light to pass therethrough. Other suitable photoconductive materials, ground layers, and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 18, idler rolls 16 and drive roller 20. Stripping roller 14 and idler rollers 16 are mounted rotatably so as to rotate with belt 10. Tensioning roller 18 is resiliently urged against belt 10 to maintain belt 10 under the desired tension. Tensioning roller 16 further contains the steering system. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At the imaging station, an imaging module indicated generally by the reference numeral 26, records an electrostatic latent image on the photoconductive surface of the belt 10. Imaging module 26 includes a raster output scanner (ROS). The ROS lays out the electrostatic latent image in a series of horizontal scan lines with each line having a specified number of pixels per inch. Other types of imaging systems may also be used employing, for example, a pivoting or shiftable LED write bar or projection LCD (liquid crystal display) or other electro-optic display as the "write" source.

Electrophotographic printing machines have increasingly utilized digital electronics technology to produce output copies from input video data representing original image information. In this case, it is known to use a raster output scanner (ROS) for exposing the charged portions of the photoconductive member to record the electrostatic latent image thereon. Generally, the ROS has a laser for generating a collimated beam of monochromatic radiation. The laser beam is modulated in conformance with the image information and is directed toward the surface of the photoconductive member through an optics system to form the desired image on the photoconductive member. In the optics system, the modulated laser beam is reflected through a lens onto a scanning element, typically a rotating polygon having mirrored facets such that the light beam is reflected from a facet and thereafter focused to a "spot" on the photoconductive member. The rotation of the polygon causes the spot to scan linearly across the photoconductive member in a fast scan (i.e., scan line) direction. Meanwhile, the photoconductive member is advanced in a process direction orthogonal to the scan line direction and relatively more slowly than the rate of the fast scan, the so-called slow scan direction. In this manner, the modulated laser beam is scanned across the recording medium in a raster scanning pattern. The light beam is intensity-modulated in accordance with an input image serial data stream at a rate such that individual picture elements ("pixels") of the image represented by the data stream are exposed on the photosensitive medium to form the latent image. As a result of the ability to precisely control the ROS, the image can be exposed on the photosensitive medium in a varying number of positions laterally with respect to the process direction.

Here, the imaging module 26 (ROS) includes a laser 110 for generating a collimated beam of monochromatic radiation 120, an electronic subsystem (ESS), located in the machine electronic printing controller 100 that transmits a set of signals via 114 corresponding to a series of pixels to the laser 110 and/or modulator 112, a modulator and beam shaping optics unit 112, which modulates the beam 120 in accordance with the image information received from the ESS, and a rotatable polygon 118 having mirror facets for sweep deflecting the beam 122 into raster scan lines which sequentially expose the surface of the belt 10 at imaging station B.

Thereafter, belt 10 advances the electrostatic latent image recorded thereon to development station C. Development station C has three magnetic brush developer rolls indicated generally by the reference numerals 34, 36 and 38. A paddle wheel picks up developer material and delivers it to the developer rolls. When the developer material reaches rolls 34 and 36, it is magnetically split between the rolls with half of the developer material being delivered to each roll. Photoconductive belt 10 is partially wrapped about rolls 34 and 36 to form extended development zones. Developer roll 38 is a clean-up roll. A magnetic roll, positioned after developer roll 38, in the direction of arrow 12 is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F, or to duplex tray 60. At finishing station F, copy sheets are stacked in a compiler tray and attached to one another to form sets. The sheets are attached to one another by either a binder or a stapler. In either case, a plurality of sets of documents are formed in finishing station F. Duplex tray 60 provides an intermediate or buffer storage for those sheets that have been printed on one side and on which an image will be subsequently printed on the second, opposite side thereof, i.e., the sheets being duplexed. The sheets are stacked in duplex tray 60 facedown on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a directional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. The high capacity variable sheet size sheet feeder of the present invention, indicated generally by the reference numeral 76, is the primary source of copy sheets. Feed belt 81 feeds successive uppermost sheets from the stack to a take-away drive roll 82 and idler rolls 84. The drive roll and idler rolls guide the sheet onto transport 86. Transport 86 advances the sheet to rolls 66 which, in turn, move the sheet to transfer station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller 100. The controller 100 is preferably a programmable microprocessor which controls all of the machine functions hereinbefore described and may also include a user interface (UI). The controller provides a comparison count of the copy sheets, the number of documents being recirculated, the number of copy sheets selected by the operator, time delays, jam corrections, etc.. The control of all of the exemplary systems heretofore described may be accomplished by conventional control switch inputs from the printing machine consoles selected by the operator. Conventional sheet path sensors or switches may be utilized to keep track of the position of the document and the copy sheets. In addition, the controller regulates the various positions of the gates depending upon the mode of operation selected. Thus, when the operator selects the finishing mode, either an adhesive binding apparatus and/or a stapling apparatus will be energized and the gates will be oriented so as to advance either the simplex or duplex copy sheets to finishing station F.

Figure 2:
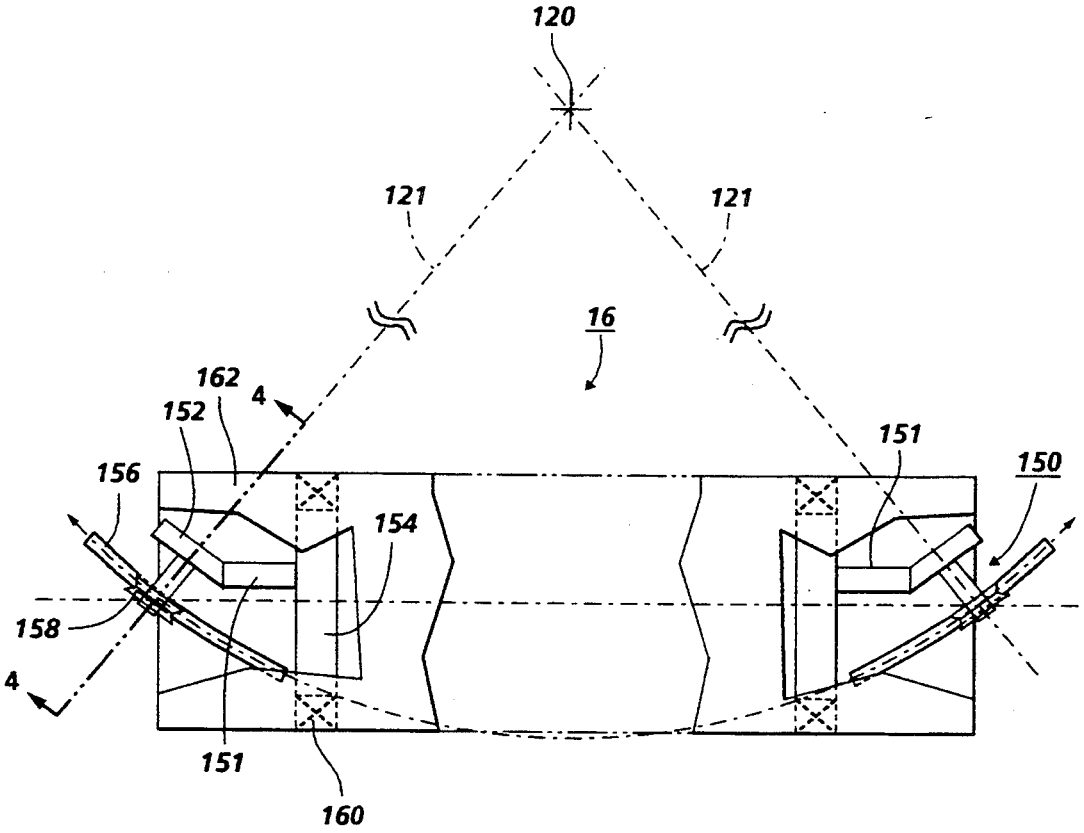
FIG. 2 is a partial sectional top view normal to the axis of the self-aligning roll of the guiding system herein.
Figure 4:
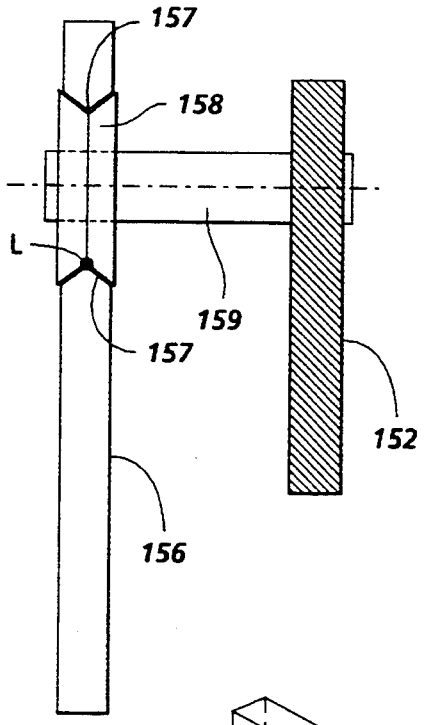
FIG. 4 is an enlarged view along the line in FIG. 2 in the direction of arrows 4—4.
Figure 3:
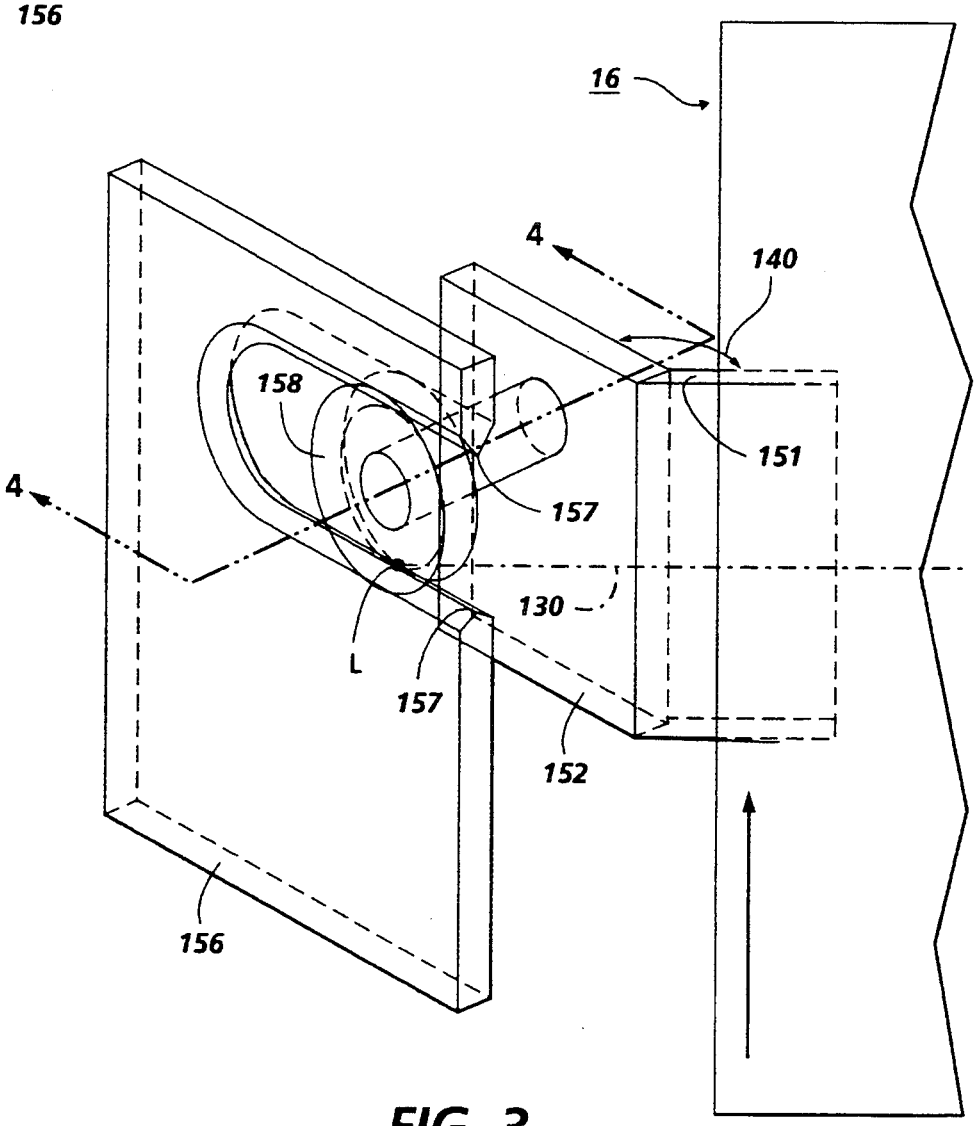
FIG. 3 is an enlarged, fragmentary perspective view of the self-aligning roll supports of the guiding system of FIG. 2.

Turning now to FIGS. 2, 3, and 4, a partial cross sectional top view of the self-aligning system is shown. The guiding system 150 is made up of a roll 16 which is a cylindrical member 162 supported on each end by a bearing 160. A support 151 is mounted to the inner bearing race 154. An angular portion 152 of the support 154 has a grooved roller 158 mounted thereon supported by a stub shaft 159. The roller 158 is arranged to ride along an opening 157 in a mounting frame 156. When a belt moves over a roller in a direction which is not exactly orthogonal to the axis of rotation of the roller itself, a kinematic tendency toward lateral motion is generated similar to that of a screw rotating in its mating threads. If the roller is otherwise constrained from moving laterally, a lateral force will be generated at the belt-roller contact within the capability of the frictional interaction of the two members. If either one or both of the two members is elastic, a lateral deflection occurs. In the event that the force exceeds the frictional capability of the contact, slip occurs.

The lateral frictional force capability of a belt-roller contact is approximately proportional to the normal contact force. The proportionality factor depends on the nature of the surfaces and is usually called "coefficient of friction". In cases which involve large normal forces, the lateral force capability can be quite large. Such is the case in which roll 16 plays the role of backup against a force externally applied to the belt, as in a pinch.

Large values of lateral force can produce a lateral steering force on the belt with consequent deterioration of the desired lateral control function applied by the steering or guiding mechanism in roll 18, and, in extreme cases, damage or poor motion quality can occur. Lateral elastic compliance of the roll surface helps reduce the level of lateral force corresponding to any wrap and misalignment angle. This is achieved by the so-called "LLF-Rolls" which are made up of a stack of coaxial rubber disks with some spacing between them. The rubber enters the contact with the belt in an undeflected state and, thereafter, it is dragged by the belt in a corkscrew path until it is released at the end of the wrap. The resulting lateral force at the contact is that necessary to deflect the disks.

Figure 1:
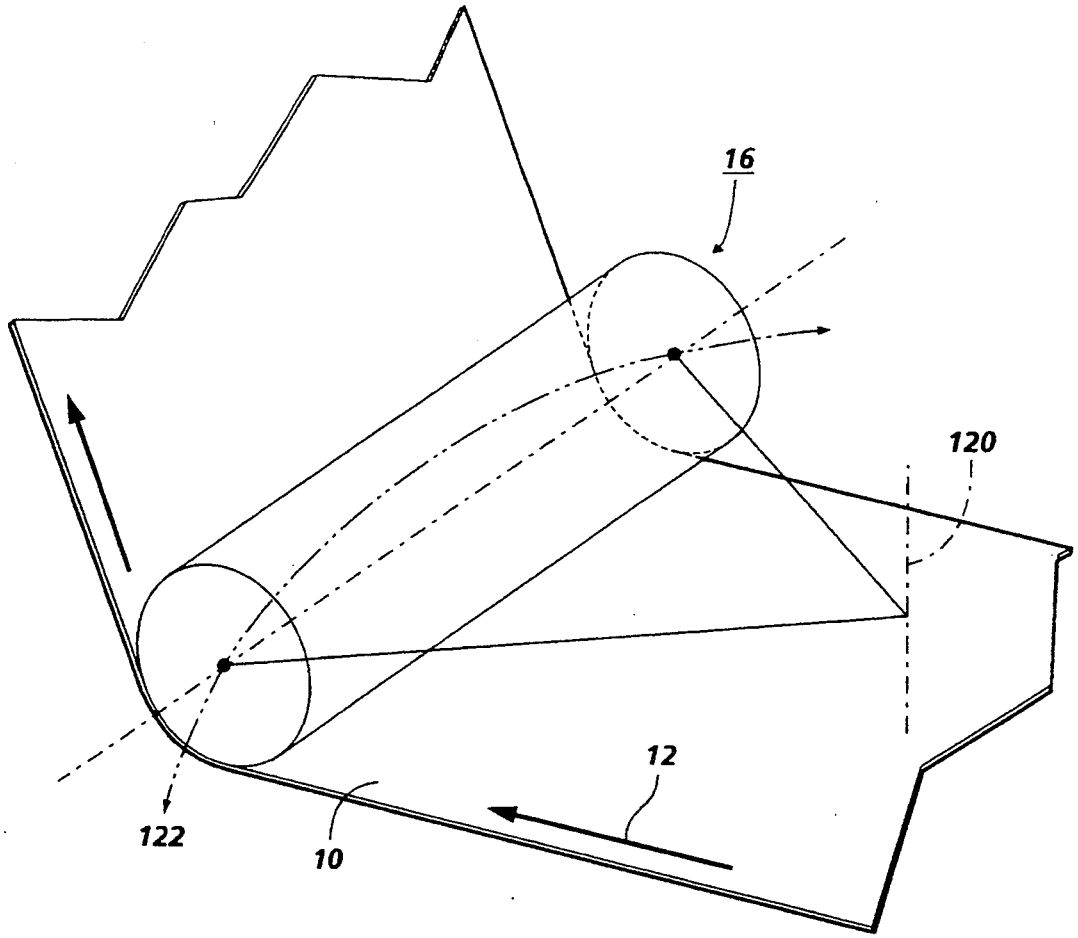
FIG. 1 is a diagram illustrating the rotational axis of the invention herein.

For cases in which large normal forces exist, as, for example, in the pinch formed by two rollers squeezing a belt, the use of LLF rolls is not satisfactory due to the discontinuity of the contact and to the possibility of buckling of the disks. Then, rather than allowing the buildup of large lateral forces on the belt, the roller can be so designed as not to be able to support any axial load. It is allowed to freely move laterally in such a way as to seek an orientation of its axis which is normal to the direction of motion of the belt. The roller lateral motion must occur as a rotation indicated by arrow 122 about an axis 120 which is roughly orthogonal to the plane of the incoming web 10 span, at its center, and upstream, as shown in FIG. 1.

The basic idea is to use a dead shaft roll and to make the assembly pivot about an axis orthogonal to the incoming belt span located in mid-width and one or two widths upstream. The intent is to eliminate yokes or swinging arms because of their cost and bulkiness.

Further details of the first embodiment are shown in FIGS. 3 and 4. A V-groove ball-bearing wheel 158 is attached to a portion of the dead shaft 152 positioned at an angle 140 from the roll axis 130. Each wheel 158 is slanted and rides in two parallel tracks 157 which are attached to the machine frame. These tracks 157 can be independent or they can be obtained out of a single component 156 as shown. The axes of rotation 121 of the two wheels 158 intersect at the desired articulation point 120 (FIGS. 1 and 2).

Each wheel is mounted eccentrically with respect to the roll in such a manner as to have the load bearing point on the roll spin axis 130. This is indicated as point L on FIGS. 3 and 4. This eliminates overturning moments due to the external load applied to the roll surface (due to the fact that all surface loads must pass through the roller spin axis if no rotational drag is present).

Each wheel 158 rolls on one of the tracks 157 and rubs against the other. However, if the point of rolling contact is located on the same line as the roll rotational axis, the resulting absence of overturning moment makes the rubbing forces small (except for tolerances). Due to the fact that it might be impractical to manufacture curved tracks as indicated by curved support 156 in FIG. 2, straight tracks will be employed in most circumstances, as it is indicated in support 156 of FIG. 3. Note that, if the support 156 and the tracks 157 are straight, the alignment of the wheels 158 with the tracks 157 deteriorates as the roll moves laterally off-center. Therefore, in this case, the extent of the roll allowed lateral motion must be limited, which requires that the built-in alignment of the belt and the roll mountings must be sufficiently good.

The extension of the outer roller tube 162 beyond endcap 154 is optional and can be utilized if the diameter is sufficiently large so that a compact self aligning roller can be obtained.

Figure 5:
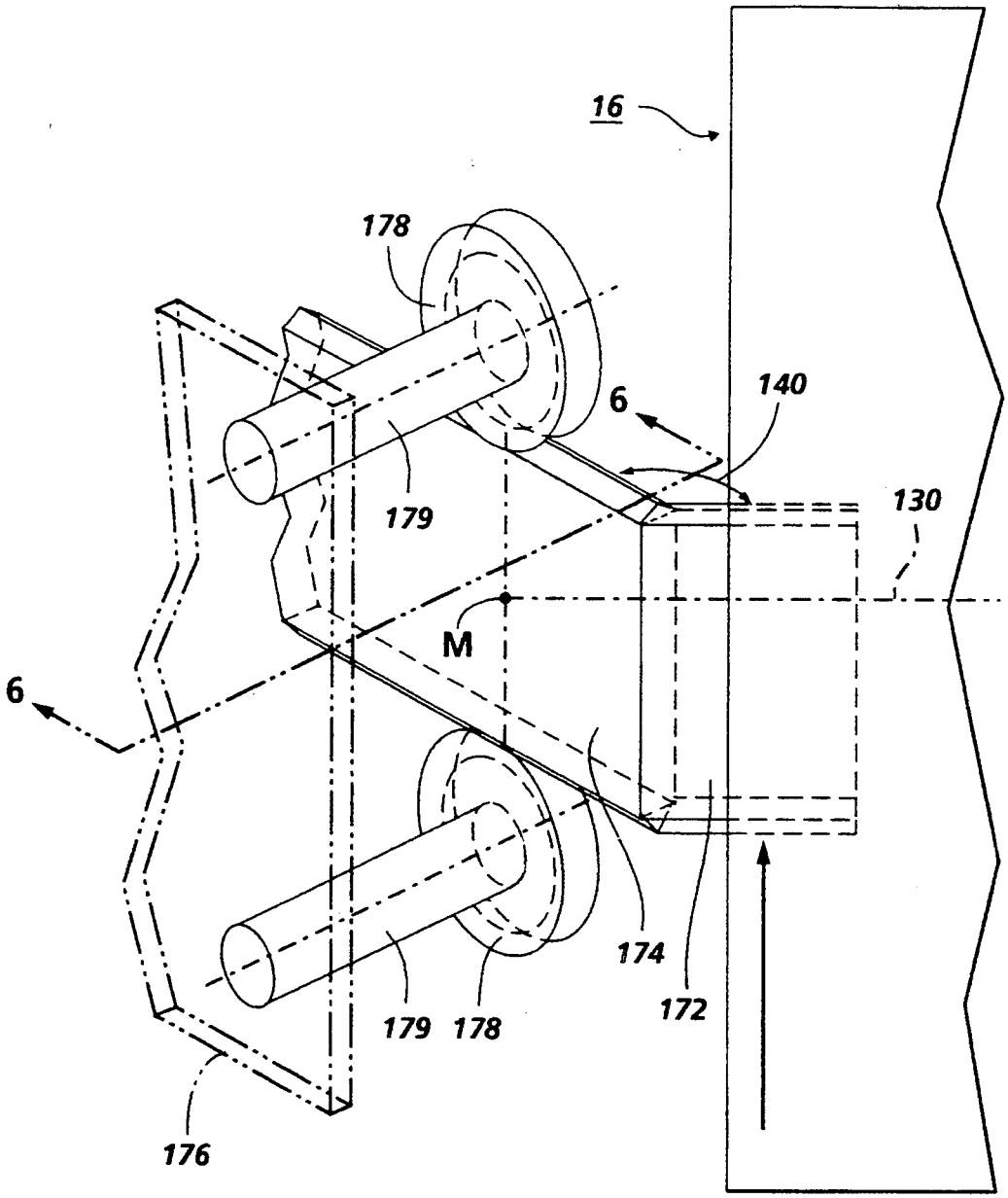
FIG. 5 is a fragmentary elevational view parallel to the v-groove rollers of a second embodiment of the invention herein.
Figure 6:
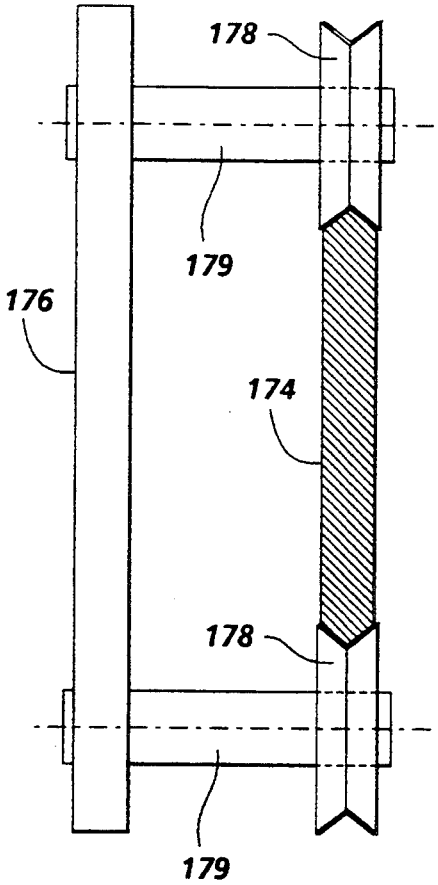
FIG. 6 is a fragmentary elevational view normal to the v-groove rollers of a second embodiment of the invention herein.
Figure 7:
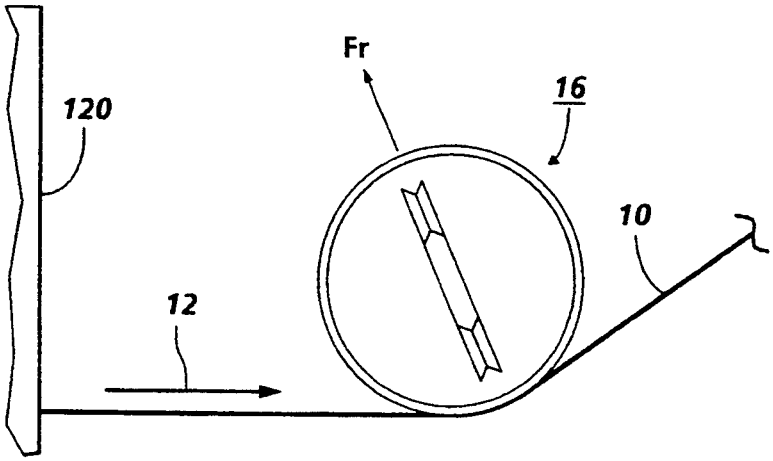
FIG. 7 is a force diagram illustrating the arrangement of the FIG. 5 embodiment.

The second embodiment is illustrated in FIGS. 5–7. It uses a double track 174 at each end of the dead shaft 172 and two mating V-groove wheels 178 on the frame 176 or stator. The double tracks 174 are mounted at angle 140 to the roll axis as the wheels were in the first embodiment.

All track-wheel contacts are rolling. This is necessary because the lateral forces on the wheels cannot be eliminated unless the plane of the double tracks contains the resultant force on the roll, which, in turn, requires the wheel-track contacts to be on the wrap bisecting plane (on which the tension force $F_t$ is located). This requirement conflicts with the desired orientation of the articulation axis 120 of FIGS. 1 and 2 as is seen in the diagram of FIG. 7. Fortunately, these devices are mostly used in loaded pinch roll situations, the wrap of which is usually small. Referring to FIG. 5, a minimum requirement for good implementation of this embodiment is that, on both sides of the roll 16, the spin axis 130 of roll 16 intersect the imaginary line which joins the central point of contact of the two wheels with the track. This will insure a minimum value of overturning moment.

However, also in this case, alignment between the spin axis and the contact points of the wheels and tracks is lost as the rolls move laterally and incremental overturning moments are created.

The first embodiment described herein is more compact than the second described embodiment while the second embodiment is more robust than the first.

In recapitulation, there is provided a guiding system for an endless loop belt which utilizes a self-aligning roll, particularly in an electrophotographic printing machine of the type having an endless photoreceptor belt supported by a plurality of rolls and arranged to move in a predetermined path through a plurality of processing stations disposed therealong the belt being of the type which is supported by a plurality of rolls. A roll for supporting the belt and in frictional contact therewith is adapted for rotational movement about a first axis. A roll support in the form of a dead shaft allows the roll to pivot about an axis in a direction substantially normal to the predetermined path direction. This is accomplished by supporting the dead shaft on a V-groove roller which rides in a track substantially along the arc of rotation normal to the predetermined path direction. Any belt tracking normal to the predetermined direction exerts a friction force on the roll causing the roll to pivot as a result of the v-groove rollers moving along the tracks in a direction substantially normal to the predetermined direction such that the roll aligns so that its axis of rotation is substantially perpendicular to the direction of travel of the belt.

It is, therefore, apparent that there has been provided in accordance with the present invention, a compact self-aligning support for an endless loop belt that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for supporting a web moving along a predetermined path, including:

a frame; and a member mounted movably in said frame in frictional contact with the web to provide support therefor, said member having an axis substantially normal to the predetermined path, said member being frictionally moved by the web, in response to the web having a direction of travel deviating from the predetermined path, in a direction substantially perpendicular to the path to substantially align the axis perpendicular to the direction of travel of the web so as to minimize lateral stress on the web.

2. An apparatus as claimed in claim 1, in which said member comprises a roll for supporting the web and in frictional contact therewith, said roll being adapted for rotational movement about a first axis.

3. An apparatus as claimed in claim 2, further comprising a roll support for attaching said roll to said frame, said roll support being laterally movable to allow the roll to pivot about a second axis in a direction substantially normal to the predetermined path direction wherein web tracking normal to the predetermined direction exerts a friction force on said roll causing said roll to pivot in a direction substantially normal to the predetermined direction such that said roll aligns so that the first axis of rotation is substantially perpendicular to the direction of travel of the web so as to minimize lateral stress on the web.

4. An apparatus for supporting a web moving along a predetermined path, including:

a frame;

a roll for supporting the web and in frictional contact therewith, said roll being adapted for rotational movement about a first axis mounted movably in said frame, said roll first axis being substantially normal to the predetermined path, said roll being frictionally moved by the web, in response to the web having a direction of travel deviating from the predetermined path, in a direction substantially perpendicular the path to substantially align the axis perpendicular to the direction of travel of the web so as to minimize lateral stress on the web, said roll comprising a pair of nonrotating members and a cylindrical web support member rotatably supported at each end by one of said pair of nonrotating members; and a roll support for attaching said roll to said frame, said roll support being laterally movable to allow the roll to pivot about a second axis in a direction substantially normal to the predetermined path direction wherein web tracking normal to the predetermined direction exerts a friction force on said roll causing said roll to pivot in a direction substantially normal to the predetermined direction such that said roll aligns so that the first axis of rotation is substantially perpendicular to the direction of travel of the web so as to minimize lateral stress on the web.

5. An apparatus as claimed in claim 4, in which said roll support includes a substantially frictionless support adapted to movably connect said nonrotating members to said frame so as to allow said cylindrical web support member to pivot in a direction substantially normal to the predetermined path direction.

6. An apparatus as claimed in claim 5, wherein said roll support comprises:

a pair of axles, each of said axles adapted to rotatably support said cylindrical member at an end thereof; and a pair of brackets, each of said brackets connected to each of said axles and defining an obtuse angle therewith, each of said brackets being adapted to engage said substantially frictionless support.

7. An apparatus as claimed in claim 6, wherein said substantially frictionless support comprises:

an axle perpendicularly attached to each of said pair of brackets; and an idler roller rotatably supported of each on said axles wherein each of said idler rollers are adapted to track in an elongated slot defined by said frame, said frame being substantially parallel to each of said brackets.

8. An apparatus as claimed in claim 6, wherein said substantially friction less support comprises:

a pair of axles perpendicularly attached to said frame adjacent to each of said brackets; and an idler roller rotatably supported on each of said pair of axles wherein each of said idler roller pairs define a journal to support each of said brackets, each of the journals being aligned with the respective said bracket.

9. An apparatus as claimed in claim 6, wherein said roll support is interior to each end of said cylindrical member.

10. An electrophotographic printing machine of the type having an endless photoreceptor belt supported by a plurality of rolls and arranged to move in a predetermined path through a plurality of processing stations disposed therealong, including:

a frame; and a member mounted movably in said frame in frictional contact with the belt to provide support therefor, said member having an axis substantially normal to the predetermined path, said member being frictionally moved by the belt, in response to the belt having a direction of travel deviating from the predetermined path, in a direction substantially perpendicular the path to substantially align the axis perpendicular to the direction of travel of the belt so as to minimize lateral stress on the belt.

11. A printing machine as claimed in claim 10, in which said member comprises a roll for supporting the belt and in frictional contact therewith, said roll being adapted for rotational movement about a first axis.

12. A printing machine as claimed in claim 11, further comprising a roll support for attaching said roll to said frame, said roll support being laterally movable to allow the roll to pivot about a second axis in a direction substantially normal to the predetermined path direction wherein web tracking normal to the predetermined direction exerts a friction force on said roll causing said roll to pivot in a direction substantially normal to the predetermined direction such that said roll aligns so that the first axis of rotation is substantially perpendicular to the direction of travel of the belt so as to minimize lateral stress on the belt.

13. An electrophotographic printing machine of the type having an endless photoreceptor belt supported by a plurality of rolls and arranged to move in a predetermined path through a plurality of processing stations disposed therealong, including:

a frame;

a roll for supporting the belt and in frictional contact therewith, said roll being adapted for rotational movement about a first axis mounted movably in said frame, said roll first axis being substantially normal to the predetermined path, said roll being frictionally moved by the belt, in response to the belt having a direction of travel deviating from the predetermined path, in a direction substantially perpendicular the path to substantially align the axis perpendicular to the direction of travel of the belt so as to minimize lateral stress on the belt, said roll comprising a pair of nonrotating members and a cylindrical belt support member rotatably supported at each end by one of said pair of nonrotating members; and a roll support for attaching said roll to said frame, said roll support being laterally movable to allow the roll to pivot about a second axis in a direction substantially normal to the predetermined path direction wherein web tracking normal to the predetermined direction exerts a friction force on said roll causing said roll to pivot in a direction substantially normal to the predetermined direction such that said roll aligns so that the first axis of rotation is substantially perpendicular to the direction of travel of the belt so as to minimize lateral stress on the belt.

14. A printing machine as claimed in claim 13, in which said roll support includes a substantially frictionless support adapted to movably connect said nonrotating members to said frame so as to allow said cylindrical belt support member to pivot in a direction substantially normal to the predetermined path direction.

15. A printing machine as claimed in claim 14, wherein said roll support comprises:

a pair of axles, each of said axles adapted to rotatably support said cylindrical member at an end thereof; and a pair of brackets, each of said brackets connected to each of said axles and defining an obtuse angle therewith, each of said brackets being adapted to engage said substantially frictionless support.

16. A printing machine as claimed in claim 15, wherein said substantially frictionless support comprises:

an axle perpendicularly attached to each of said pair of brackets; and an idler roller rotatably supported of each on said axles wherein each of said idler rollers are adapted to track in an elongated slot defined by said frame, said frame being substantially parallel to each of said brackets.

17. A printing machine as claimed in claim 15, wherein said substantially frictionless support comprises:

a pair of axles perpendicularly attached said frame adjacent to each of said brackets; and an idler roller rotatably supported on each of said pair of axles wherein each of said idler roller pairs define a journal to support each of said brackets, each of the journals being aligned with the respective said bracket.

18. A printing machine as claimed in claim 15, wherein said roll support is interior to each end of said cylindrical member.

* * * * *